US006252198B1

(12) United States Patent
Malkin

(10) Patent No.: US 6,252,198 B1
(45) Date of Patent: Jun. 26, 2001

(54) ELECTRICALLY HEATED PANEL APPARATUS

(75) Inventor: Raymond Malkin, Ashton under Lyne (GB)

(73) Assignee: Pulse Home Products Limited, Oldham (GB)

( * ) Notice: Subject to any disclaimer, the term of this patent is extended or adjusted under 35 U.S.C. 154(b) by 0 days.

(21) Appl. No.: 09/626,153

(22) Filed: Jul. 26, 2000

Related U.S. Application Data

(63) Continuation of application No. PCT/GB98/03613, filed on Dec. 3, 1998.

(30) Foreign Application Priority Data

Feb. 16, 1998 (GB) ..... 9803272

(51) Int. Cl.[7] ..... H05B 1/00; H05B 3/00; H05B 11/00

(52) U.S. Cl. ..... 219/212; 219/528

(58) Field of Search ..... 219/212, 528, 219/501, 505, 539, 549, 497

(56) References Cited

U.S. PATENT DOCUMENTS

| | | | | |
|---|---|---|---|---|
| 3,375,477 | | 3/1968 | Kawazoe . | |
| 3,493,727 | | 2/1970 | Hosokawa et al. . | |
| 3,679,872 | * | 7/1972 | Lauck, III | 219/501 |
| 4,034,185 | * | 7/1977 | Crowley | 219/212 |
| 4,205,223 | * | 5/1980 | Cole | 219/501 |
| 4,278,874 | * | 7/1981 | Cole | 219/505 |
| 4,491,723 | * | 1/1985 | Cole | 219/505 |
| 4,547,154 | * | 10/1985 | Crowley | 219/539 |
| 4,607,154 | * | 8/1986 | Mills | 219/505 |
| 4,998,006 | * | 3/1991 | Perlman | 219/212 |
| 5,081,341 | * | 1/1992 | Rowe | 219/505 |
| 5,206,485 | * | 4/1993 | Srubas et al. | 219/549 |
| 5,403,992 | * | 4/1995 | Cole | 219/528 |
| 5,861,610 | * | 1/1999 | Weiss | 219/497 |

FOREIGN PATENT DOCUMENTS

| | | |
|---|---|---|
| 1 193 593 | 11/1959 | (FR) . |
| 2 590 433 | 5/1987 | (FR) . |
| 746 017 | 3/1956 | (GB) . |
| 1 168 162 | 10/1969 | (GB) . |
| 1 566 005 | 4/1980 | (GB) . |
| 2 045 023 | 10/1980 | (GB) . |
| 2 148 677 | 5/1985 | (GB) . |
| 2 162 005 | 1/1986 | (GB) . |

* cited by examiner

*Primary Examiner*—Teresa Walberg
*Assistant Examiner*—Leonid Fastovsky
(74) *Attorney, Agent, or Firm*—Nixon & Vanderhye P.C.

(57) ABSTRACT

A heating element (2) for an electrically heated panel (22) is provided having a heating conductor (4), a first temperature sensing conductor (6) and a second temperature sensing conductor (8). The first temperature sensing conductor (6) and the second temperature sensing conductor (8) are separated via a layer of material whose impedance varies with temperature. The second temperature sensing connector (8) is straight tinsel conductor whilst the first temperature sensing conductor (6) and the heating conductor (4) are helical wound in opposite senses about the axis of the heating element (2).

11 Claims, 2 Drawing Sheets

ELECTRICALLY HEATED PANEL APPARATUS

Figure 1:
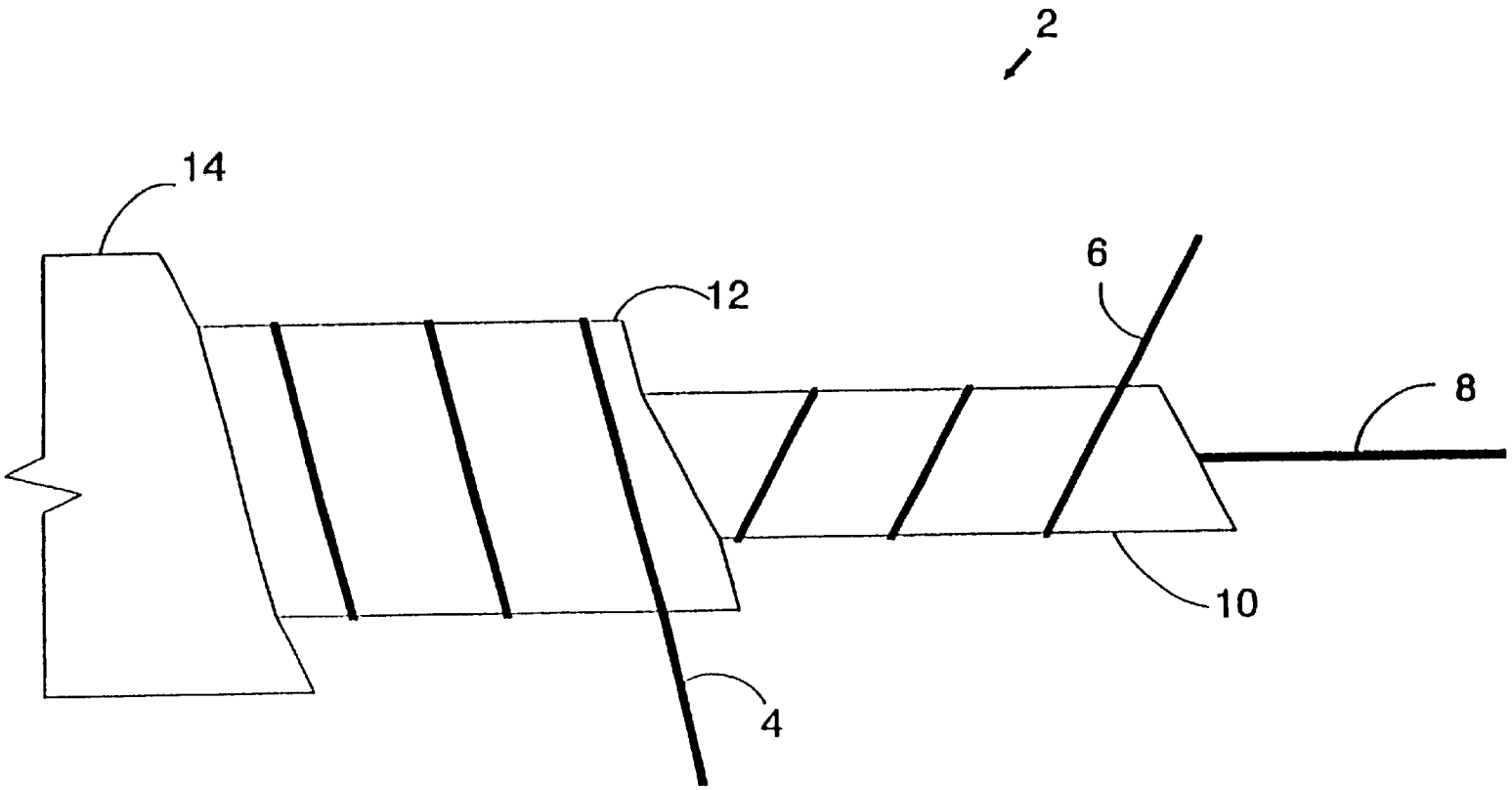

This is a continuation of PCT application PC/GB98/03613, filed Dec. 3, 1998, the entire content of which is hereby incorporated by reference in this application.

This invention relates to the field of electrically heated panels. More particularly, the present invention relates to electrically heated panels including sensor wires within the panel between which electrical impedance is detected to gain a measurement of the temperature of the panel.

It is known to provide electrically heated panels in the form of electric blankets for beds that include a heating element following a zigzag path through the blanket. Given that such devices may be used unattended to preheat a bed, or used overnight whilst the occupant of the bed sleeps, it is desirable that the device should include measures to prevent dangerous overheat conditions developing. This problem is made more difficult by the varying levels of insulation that may be provided over the heated blanket making the temperature attained with a given power input vary considerably. Furthermore, the temperature that the bed is to be preheated to or the overnight setting that should be used is difficult to control using only preset power levels.

For the above reasons, it has been proposed to provide, in addition to the heating wire, sensor wires within the blanket between which there is a temperature responsive layer with an impedance that varies with temperature. In this way the impedance between the sensor wires can be measured to gain an indication of the actual temperature within the blanket and this can then be fedback to control the power setting or a safety cut out.

It is an aim within such electrically heated panels to increase the reliability of the operation, thereby increasing safety, and to reduce the cost of manufacture of the panels.

Viewed from one aspect there is provided an electrically heated panel apparatus comprising:

a heating element having a heating conductor, a first temperature sensing conductor and a second temperature sensing conductor, said heating conductor, said first temperature sensing conductor and said second temperature sensing conductor being coaxially and integrally formed, said first temperature sensing conductor and said second temperature sensing conductor being separated by a temperature responsive layer with an impedance that varies with temperature, and said heating conductor being separated from said first temperature sensing conductor and said second temperature sensing conductor by an insulating layer, and a temperature sensing circuit connected to said first temperature sensing conductor and said second temperature sensing conductor for controlling current flowing through said heating conductor in dependence upon a sensed impedance of said temperature responsive layer.

Providing the heating wire and the sensors wires together in the same heating element ensures that the sensor wires are in excellent thermal contact with the heater wire and so are exposed to the maximum temperature that is present within the blanket. Furthermore, since the heater element contains all of the wires that need to be passed through the blanket, only the single element needs to be fed through the zigzag path within the blanket thereby reducing the manufacturing costs compared to having to fit both a heater element and a separate sensor element.

The heating conductor and sensing conductors could be arranged in different relative orders within the heating element. In preferred embodiments said heating conductor is disposed within said heating element radially outwardly of said first temperature sensing conductor and said second temperature sensing conductor. This arrangement allows the heating conductor to efficiently heat the blanket without the sensing conductors providing a barrier.

The tensile strength and reliability of the performance of the heating element is improved in embodiments in which a radially innermost of said conductors is a straight conductor running along a central axis of said heating element with radially outer of said conductors being helical wound about said central axis.

The safety of the blanket is improved in embodiments in which two of said conductors are helical wound in opposite directions around a central axis of said heating element and said electrically heated panel apparatus includes a circuit for detecting a short circuit between said conductors. If an overheat condition arises such that the insulation between the conductors melts, then the counter-wound conductor will short circuit even if the overheat is highly localized and this short circuit can be detected.

An effective and inexpensive temperature responsive layer is doped polyvinylchloride.

Temperature responsive properties well suited to use in a heated panel are provided when said polyvinylchloride is doped with steayl dimethyl benzyl ammonium chloride.

Efficient operation and an inexpensive construction is achieved when at least one of said heating conductor, said first temperature sensing conductor and said second temperature sensing conductor are comprise copper wire.

An advantageous balance between cost and performance is achieved in embodiments in which said helical wound conductors have between 800 and 1500 turns per meter.

In addition to controlling the normal power setting, the sensor wires may be advantageously used in embodiments having an overheat protection circuit responsive to said temperature sensing circuit to interrupt current flow through said heating conductor should the sensed temperature of said heating element exceed a predetermined threshold value.

Effective fail-safe isolation of the circuit is provided by embodiments in which said overheat protection circuit includes a thermal fuse arranged to interrupt current supply to said apparatus when said sensed temperature of said heating element exceed said predetermined threshold value.

Whilst the invention may be used in various forms of electrically heated panel apparatus, it is particularly well suited for use in an electric blanket.

Figure 2:
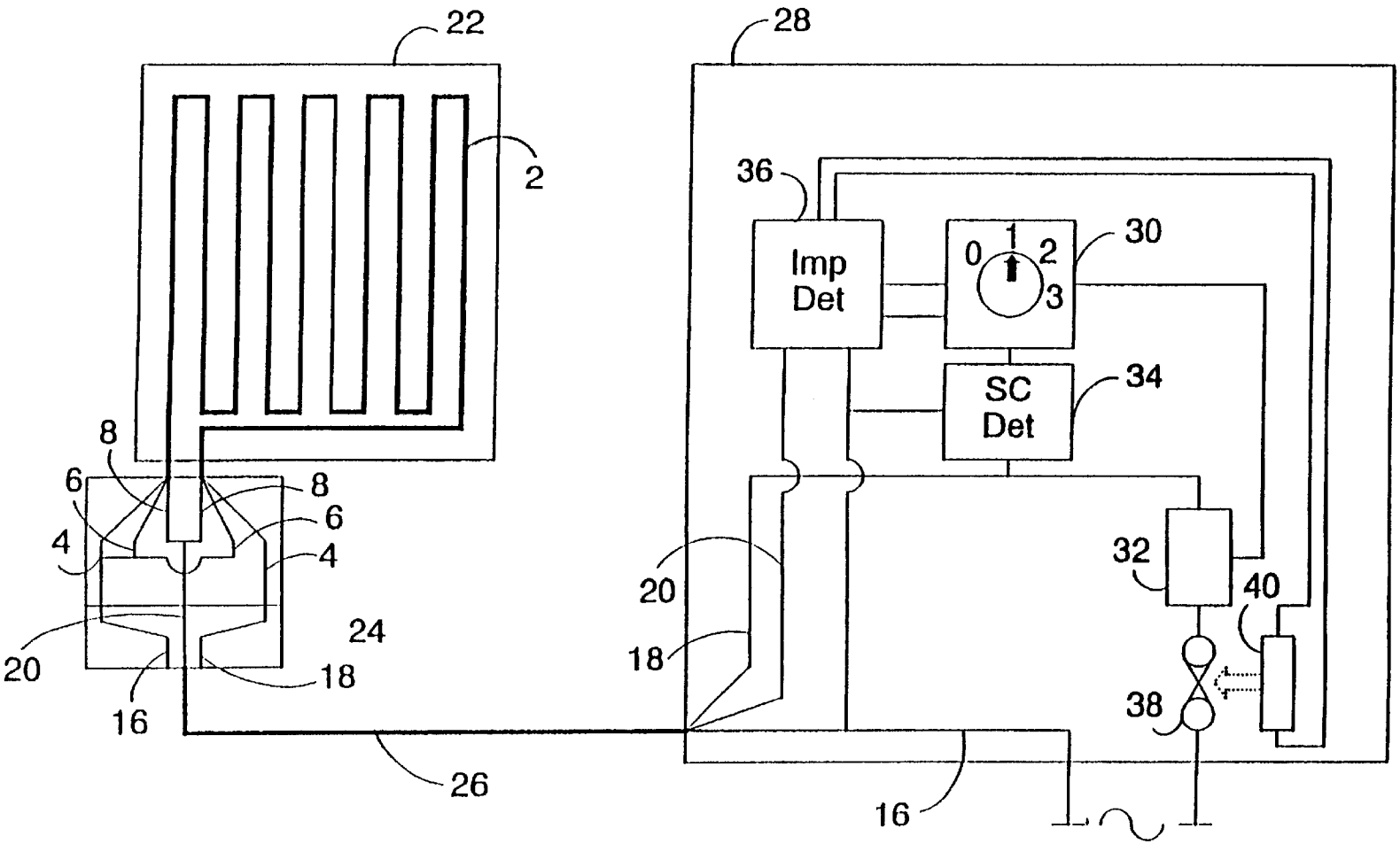

An embodiments of the invention will now be described, by way of example only, with reference to the accompanying drawings in which:

FIG. 1 shows a partially cutaway view of a heater element for an electric blanket; and FIG. 2 illustrates an electrically heated panel circuit using the heating element of FIG. 1.

FIG. 1 shows a partially cut away view of a heater element 2. The heater element 2 comprises an outer heating conductor 4, a first temperature sensing conductor 6 and a second temperature sensing conductor 8. The heating conductor 4 and the first temperature sensing conductor 6 comprise copper wire. The second temperature sensing conductor 8 is straight tinsel conductor lying along the axis of the heating element 2. The first temperature sensing conductor 6 is helically wound around the second temperature sensing conductor 8. A layer of doped polyvinylchloride 10 is disposed between the second temperature sensing conductor 8 and the first temperature sensing conductor 6. The impedance of this doped polyvinylchloride layer 8 varies with temperature.

An insulating layer 1 is provided around the first temperature sensing conductor 6. The heating conductor 4 is helically wound around this insulating layer 12 with a turn direction that is opposite to that of the first temperature sensing conductor 6. An outer insulating layer 14 is provided over the heating conductor 4 and forms the outer surface of the heating element 2. The insulating layer 12 is chosen to have a melting point such that if an overheat condition develops along the heating element 2, then the insulating layer 12 softens such that the heating conductor and the first temperature sensing conductor will contact one another and provide a "short-circuit" that can be detected by the blanket controller and used to trigger a safety cut-out mechanism.

The doped polyvinylchloride layer 10 may be doped with steayl dimethyl benzyl ammonium chloride in order to provide it with the property that its impedance varies with temperature within the desired operating temperature range. The pitch of the first temperature sensing conductor 6 and the heating conductor 4 may be in the range 800 and 1500 turns per meter.

FIG. 2 schematically illustrates a heated panel circuit. An electrically heated panel 22 is provided with a heating element 2 running in a zigzag pattern through the heated panel 22. A plug and socket block 24 is connected to the edge of the heated panel 22. This connects the heated panel 22 via a three-core cable 26 to a panel controller 28. The three-core flex 26 includes a common ground line 16 which is coupled to one end of the heating conductor 4 and both ends of the first temperature sensing conductor 6. A heating power line 18 is connected to the other end of the heating conductor 4. An impedance sensing line 20 is connected to both ends of the second temperature sensing conductor 8.

Within the panel controller 28 there is provided a power controller 30 that selectively renders conductive a triac 32 to pass a desired proportion of mains voltage half cycles through the heating conductor 4 so as to thereby control the power level of the heating element 2. A short circuit detecting circuit 34 is provided to sense short-circuits between the heating power line 18 and the common ground line 16. If such short circuits are detected, then the short circuit detecting circuit passes a signal to the control circuit 30 to control the control circuit 30 to render fully non-conductive the triac 32.

An impedance detecting circuit 36 is provided to sense the impedance between the impedance sensing line 20 and the common ground line 16. The impedance detecting circuit 36 is thus able to effectively measure the temperature of the heating element 2. This measurement can provide a feedback signal to the control circuit 32 to adjust the power level being passed by the triac 32 so as to achieve a desired temperature of the heating element 2. If the impedance detecting circuit 36 detects an impedance indicative of an overheat of the heating element 2, then it can operate a fail-safe mechanism to interrupt the power supply to the heated panel by breaking a thermal fuse 38 via resistor 40.

What is claimed is:

1. An electrically heated panel apparatus comprising:

a heating element having a heating conductor, a fast temperature sensing conductor and a second temperature sensing conductor, said heating conductor, said first temperature sensing conductor and said second temperature sensing conductor being coaxially and integrally formed, said first sensing conductor and said second temperature sensing conductor being separated by a temperature responsive layer with an impedance that varies with temperature, and said heating conductor being separated from said first temperature sensing conductor and said second temperature sensing conductor by an insulating layer; and a temperature sensing circuit connected to said first temperature sensing conductor and said second temperature sensing conductor for controlling current flowing through said heating conductor in dependence upon a sensed impedance of said temperature responsive layer.

2. An apparatus as claimed in claim 1, wherein said heating conductor is disposed within said heating element radially outwardly of said first temperature sensing conductor and said second temperature sensing conductor.

3. Apparatus as claimed in claim 1, wherein a radially innermost of said conductors is a straight conductor running along a central axis of said heating element with radially outer of said conductors being helical wound about said central axis.

4. Apparatus as claimed in claim 1, wherein two of said conductors are helical wound in opposite directions around a central axis of said heating element and said electrically heated panel apparatus includes a circuit for detecting a short circuit between said conductors.

5. Apparatus as claimed in claim 1, wherein said temperature responsive layer is doped polyvinylchloride.

6. Apparatus as claimed in claim 5, wherein said polyvinylchloride is doped with steayl dimethyl benzyl ammonium chloride.

7. Apparatus as claimed in claim 1, wherein at least one of said heating conductor, said first temperature sensing conductor and said second temperature sensing conductor are comprise copper wire.

8. Apparatus as claimed in claim 3, wherein said helical wound conductors have between 800 and 1500 turns per meter.

9. Apparatus as claimed in claim 1 comprising an overheat protection circuit responsive to said temperature sensing circuit to interrupt current flow through said heating conductor should the sensed temperature of said heating element exceed a predetermined threshold value.

10. Apparatus as claimed in claim 1, wherein said overheat protection circuit includes a thermal fuse arranged to interrupt current supply to said apparatus when said sensed temperature of said heating element exceed said predetermined threshold value.

11. Apparatus as claimed in claim 1, wherein said electrically heated panel apparatus is an electric blanket.

* * * * *